US008096859B2

(12) United States Patent
Schimweg

(10) Patent No.: US 8,096,859 B2
(45) Date of Patent: Jan. 17, 2012

(54) HONING TOOL HAVING ENHANCED WEAR RESISTANCE PROPERTIES

(75) Inventor: John J. Schimweg, St. Charles, MO (US)

(73) Assignee: Sunnen Products Company, St. Louis, MO (US)

( * ) Notice: Subject to any disclaimer, the term of this patent is extended or adjusted under 35 U.S.C. 154(b) by 611 days.

(21) Appl. No.: 12/337,891

(22) Filed: Dec. 18, 2008

(65) Prior Publication Data

US 2010/0159812 A1 Jun. 24, 2010

(51) Int. Cl.
*B24B 9/02* (2006.01)

(52) U.S. Cl. ..... 451/470; 451/533; 451/534

(58) Field of Classification Search ..... 451/470, 451/533, 534

See application file for complete search history.

(56) References Cited

U.S. PATENT DOCUMENTS

| | | | | |
|---|---|---|---|---|
| 4,197,680 | A * | 4/1980 | Althen et al. | 451/475 |
| 4,253,279 | A * | 3/1981 | Althen | 451/478 |
| 5,178,643 | A * | 1/1993 | Schimweg | 51/293 |
| 5,725,421 | A * | 3/1998 | Goers et al. | 451/303 |
| 5,928,394 | A * | 7/1999 | Stoetzel | 51/295 |
| 7,073,496 | B2 * | 7/2006 | Corcoran | 125/15 |
| 2003/0126800 | A1 * | 7/2003 | Seth et al. | 51/293 |
| 2003/0194957 | A1 * | 10/2003 | Schulz et al. | 451/180 |
| 2009/0239454 | A1 * | 9/2009 | Yamashita et al. | 451/443 |

* cited by examiner

*Primary Examiner* — Maurina Rachuba
(74) *Attorney, Agent, or Firm* — Matthews Edwards LLC

(57) ABSTRACT

A honing tool for honing holes in workpieces, having an abrasive portion including a first abrasive layer therearound of abrasive particles of a first size, including a region having a second abrasive layer of abrasive layers of a second size sufficiently smaller than the first size, so as to be disposed in interstices between abrasive particles of the first abrasive layer without altering the diametrical size of the first layer, and so as to provide enhanced wear resistance.

24 Claims, 5 Drawing Sheets

HONING TOOL HAVING ENHANCED WEAR RESISTANCE PROPERTIES

TECHNICAL FIELD

The present invention relates to a honing tool for honing holes in workpieces, and more particularly, to a honing tool having a first abrasive layer therearound of abrasive particles of a first size, including a region having a second abrasive layer of abrasive layers of a second size sufficiently smaller than the first size, so as to be disposed in interstices between abrasive particles of the first abrasive layer without altering the diametrical size of the first layer, and so as to provide enhanced wear resistance. The tool has particularly good utility for honing blind holes.

BACKGROUND ART

Honing generally involves moving a honing tool reciprocatingly through a hole or bore of a workpiece, with an outer abrasive surface of the tool in abrading contact with the surface defining the hole or bore, and while rotating the tool. Typically, it is desired to impart very precise cylindricality and roundness to the surface of defining the hole, and a fine surface finish (cross-hatch pattern, etc.) may be sought. Any significant taper, barrel shape, skew, out of roundness, or other deviation is considered bad, and could result in scrapping of the workpiece. Cost is also typically important, and thus the consumption rate of honing tools (tool wear) is a concern.

Patterns of tool wear are also of concern, as if the abrasive surface of a honing tool wears unevenly, this may produce a corresponding unevenness or non-uniformity in the surface of the hole or bore being honed.

Some honing applications, particularly blind holes or bores, that is, holes that have an open end and an opposite closed or blind end, and stepped holes, can present a problem by preventing or limiting movements (overstroking) of the honing tool in one direction, particularly the direction beyond the closed or blind end, or the step. This can be a problem, as the portion of the abrasives on the end of the honing tool used for honing near or to the blind or stepped end of the hole are in abrading contact with the workpiece surface to for a greater extent of the honing stroke compared to the abrasives on the opposite end of the tool, resulting in uneven abrasive wear from end to end, particularly, more wear toward the free end or tip of the tool. The tool thus loses its original profile shape, e.g., cylindrical, such that workpiece holes honed with the tool will be correspondingly misshaped, e.g. choked or reduced in diameter adjacent to the blind end or step. This problem is increased when honing holes or bores in workpieces composed of very hard or tough materials, and to avoid this problem the abrasive elements of the honing tools, e.g. outer tubular members or sleeves, or the entire tools, must be replaced more frequently, such that tool consumption and resultant honing cost per workpiece is unacceptably high.

Thus, what is sought is a honing tool with improved wear resistance, which provides a capability for honing blind holes, and which overcomes one or more of the problems and shortcomings set forth above.

SUMMARY OF THE INVENTION

What is disclosed is a honing tool for honing holes in workpieces, and more particularly, blind holes or bores in workpieces, which provides improved wear resistance, and overcomes one or more of the problems and shortcomings set forth above.

According to one preferred aspect of the invention, the honing tool is configured for honing a substantially cylindrical surface extending around and defining a hole in a workpiece, and includes an elongate radially expandable tubular member having a mounting end configured for attaching to a honing machine, and an opposite free end portion configured to be insertable into the hole in the workpiece. The tubular member includes a radially outwardly facing outer cylindrical surface. The tool includes at least one expander member located within the tubular member and movable relative thereto for radially expanding the tubular member in the hole of the workpiece. The outer cylindrical surface of the tubular member includes a longitudinally extending region thereabout including a first layer of abrasive particles of a first size bonded thereto, and preferably, only a longitudinal endmost portion of the first layer of the abrasive particles of the first size adjacent to the free end portion additionally has a second layer of abrasive particles bonded thereto. Substantially all of the abrasive particles of the second layer are of a second size which is equal to about one-half the first size or less, and the particles of the second layer are located at least substantially within interstices or voids between the particles of the first layer, such that the region of the outer cylindrical surface, including the portion thereof having just the first layer of the abrasives, and the portion including both layers, has a substantially uniform outer diameter.

An attendant advantage of the honing tool described above is a substantially increased wear resistance, uniform along the length of the abrasive area of the tool, such that the tool retains its cylindrical profile shape after honing a substantial number of blind or other holes or bores in workpieces in an asymmetrical manner, i.e., wherein overstroking in the direction of the blind end, step, shoulder, etc., is not possible. As a result, workpiece cylindricality over a large number of workpieces is achieved, while honing costs are reduced.

According to another preferred aspect of the invention, the first abrasive layer contains a maximum concentration of the abrasive particles of the first size, such that the sizes of the interstices or voids between adjacent ones of those particles are minimized. This is advantageous, as it maximizes wear resistance, which are increased or supplemented on the endmost region of the tool by the presence of the second abrasive layer, with the result of substantially uniform wear over the length of the abrasive region of the tool when used in a longitudinally asymmetrical honing application, such as a blind or stepped hole.

According to another preferred aspect of the invention, substantially all of the interstices between the particles of the first layer in which the particles of the second layer are located, are located at least substantially radially outwardly of radial centers of the particles of the first layer, respectively. As a result, although applied over the first abrasive layer, the particles of the second layer effectively and substantially uniformly nest within the first abrasive layer, and the cylindrical uniformity over the longitudinal extent of the abrasive portion of the tool is achieved.

According to another preferred aspect of the invention, the endmost portion including both layers of abrasives, comprises less than about one-third of an overall longitudinal extent of the first layer, and is optimally about one-fifth of the overall extent for a variety of applications.

According to another preferred aspect of the invention, the first size is within a range of from about 0.10 millimeter to about 0.20 millimeter, and the second size is within a range of from about 0.05 millimeter to about 0.10 millimeter. As another preferred size range if larger abrasives are desired or required, the first size can be within a range of from about 0.20 millimeter to about 0.30 millimeter, and the second size within a range of from about 0.10 millimeter to about 0.15 millimeter, and other sizes can be used, as long as the second size is no more than about one-half the first size.

According to a further preferred aspect of the invention, the particles of the first size are bonded to the tubular member by a first layer of a binder, and the particles of the second layer are bonded to the first layer of the binder by a second layer of a binder, the binders preferably comprising conventional plating.

And, according to another preferred aspect of the invention, the free end portion of the tubular member is split to facilitate expansion thereof.

Still further, it is contemplated that honing tools of other shapes, such as single or multiple tapered shapes, or those using an array of radially movable stones or sticks about a mandrel or shell, can include the multiple abrasive layer construction of the invention as set forth above, to provide enhanced wear resistance and other advantages.

DETAILED DESCRIPTION OF THE INVENTION

Figure 1:
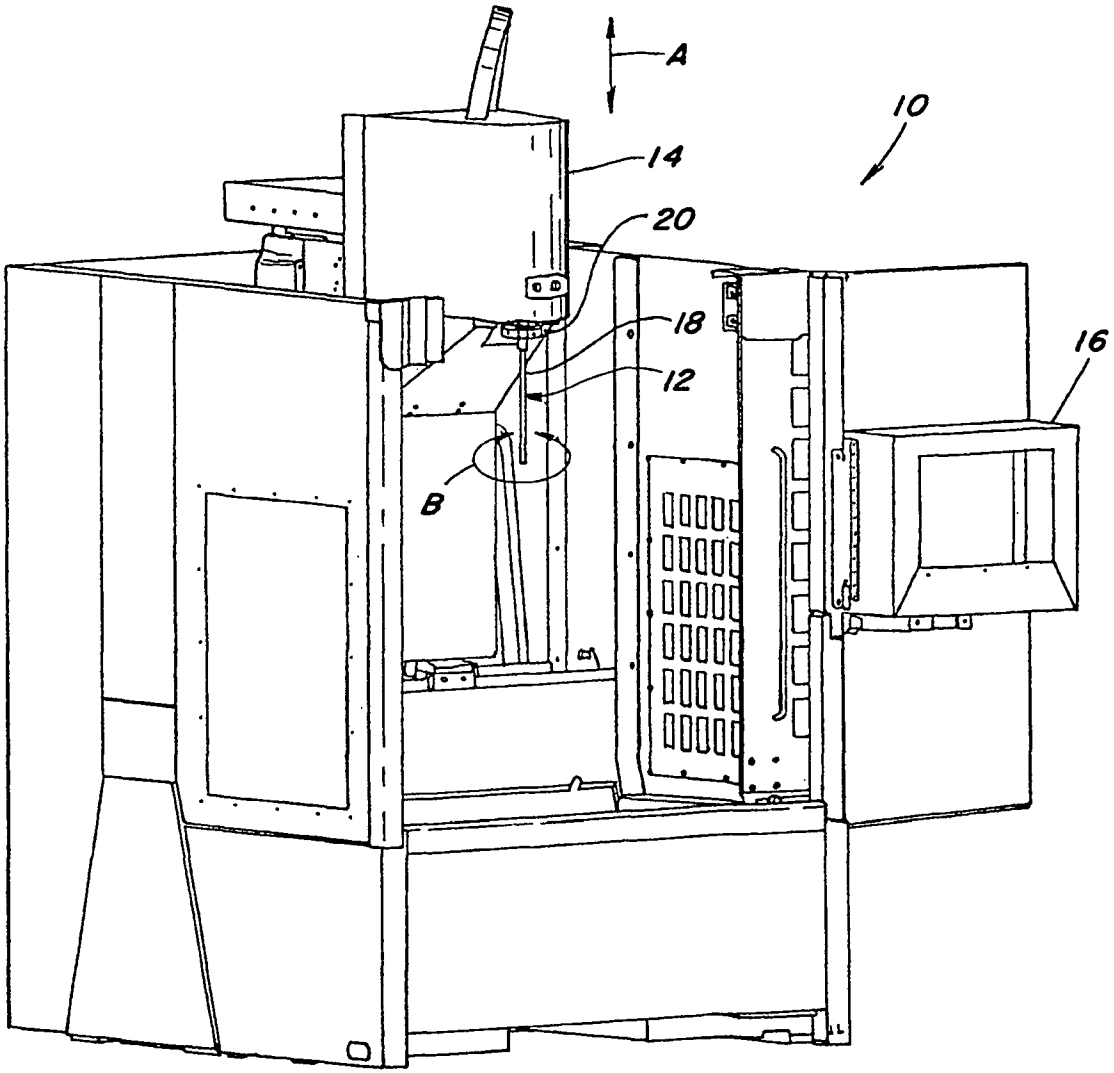
FIG. 1 is a perspective view of a representative honing machine including a honing tool constructed and operable according to the present invention.

Referring now to the drawings by reference numbers, FIG. 1 shows a representative honing machine 10, including a honing tool 12 constructed and operable according to the teachings of the present invention. Honing machine 10 is conventionally constructed and operable, and includes a carriage which supports honing tool 12, while reciprocatingly moving it upwardly and downwardly in a stroking action, as denoted by arrow A. Honing tool 12 is supported by a spindle of carriage 14, which rotates the tool about a central vertical axis therethrough, as denoted by arrow B, during the stroking action. As discussed below, an abrasive region of honing tool 12 is configured to be radially expandable, which expansion will occur when the tool is located in a hole or bore of a workpiece to be honed, held in a fixture of machine 10 below carriage 14. The length, upper and lower extents, and rates of speed and acceleration of the honing stroke, and the rotational speed or speeds of tool 12 will be determined, and programmed into a processor based controller 16 of machine 10, which operatively controls the movements of carriage 14, in the well known manner.

Figure 2:
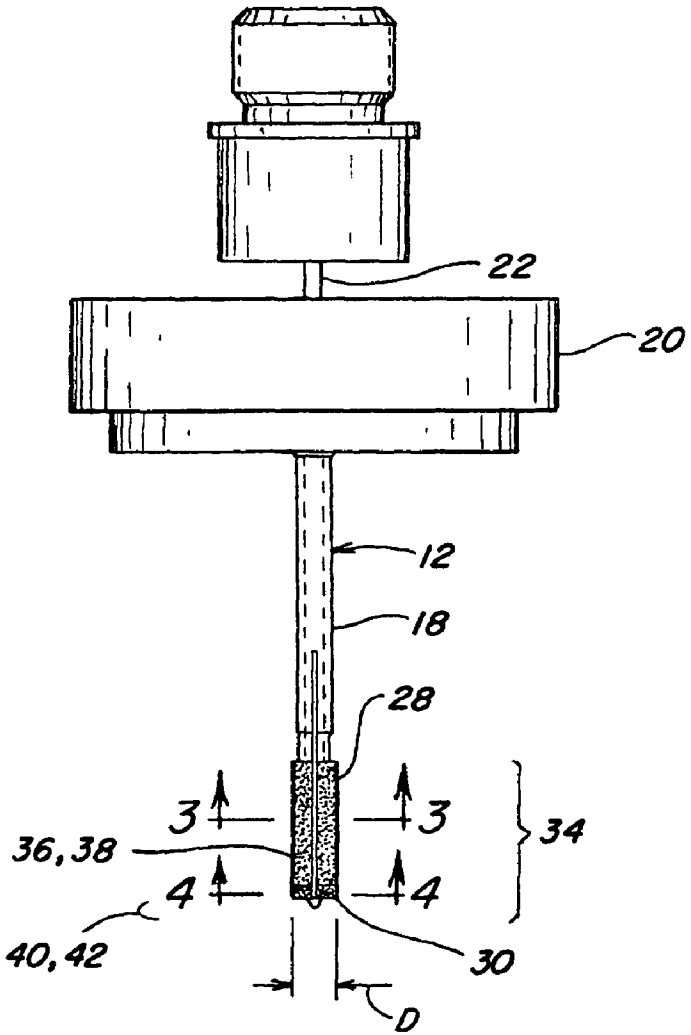
FIG. 2 is a side view of the honing tool of FIG. 1.

Referring also to FIG. 2, honing tool 12 comprises an assembly including an elongate radially expandable tubular member 18 which is fixedly attached to a hub portion 20, which mounts to the spindle of carriage 14 for upward and downward and rotational movement therewith during the honing stroke. Honing tool 12 includes at least one expander member 22 located within tubular member 18, which here comprises a single elongate, tapered wedge member. Expander member 22 mounts to a longitudinally movable member of carriage 14, so as to be longitudinally movable within and relative to tubular member 18 for effecting radial expansion and retraction thereof, in the well known manner.

Figure 3:
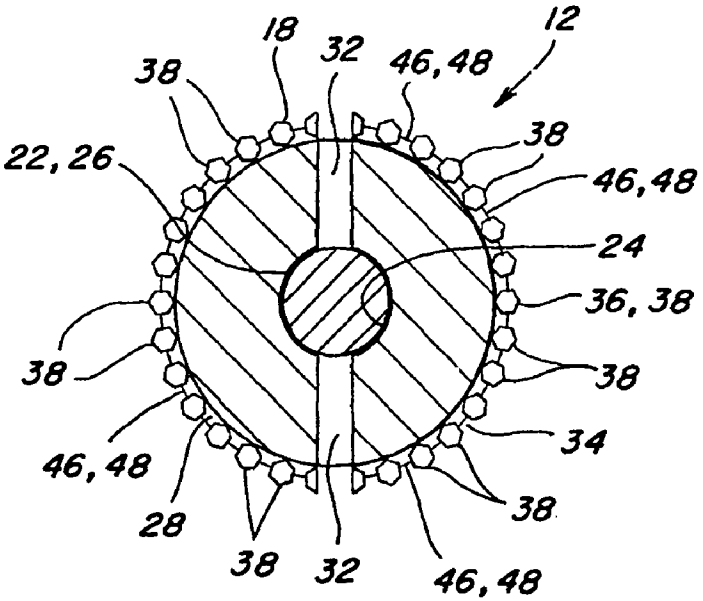
FIG. 3 is a cross-sectional view taken along line 3-3 of FIG. 2.

Referring also to FIG. 3, tubular member 18 includes a longitudinally extending, radially inwardly facing tapered surface 24, defining and extending around a central longitudinal passage containing expander member 22, which has a radially outwardly facing tapered surface 26 that matingly slidingly engages tapered surface 24 for the relative longitudinal movement required for radially expanding and retracting tubular member 18. Tubular member 18 of the illustrated tool 12 has an outer cylindrical surface 28 adjacent to a free end 30 of member 18, which is split, as effected by slots 32, so as to be radially expandable and retractable by the relative longitudinal movement of expander member 22, as just discussed.

Figure 4:
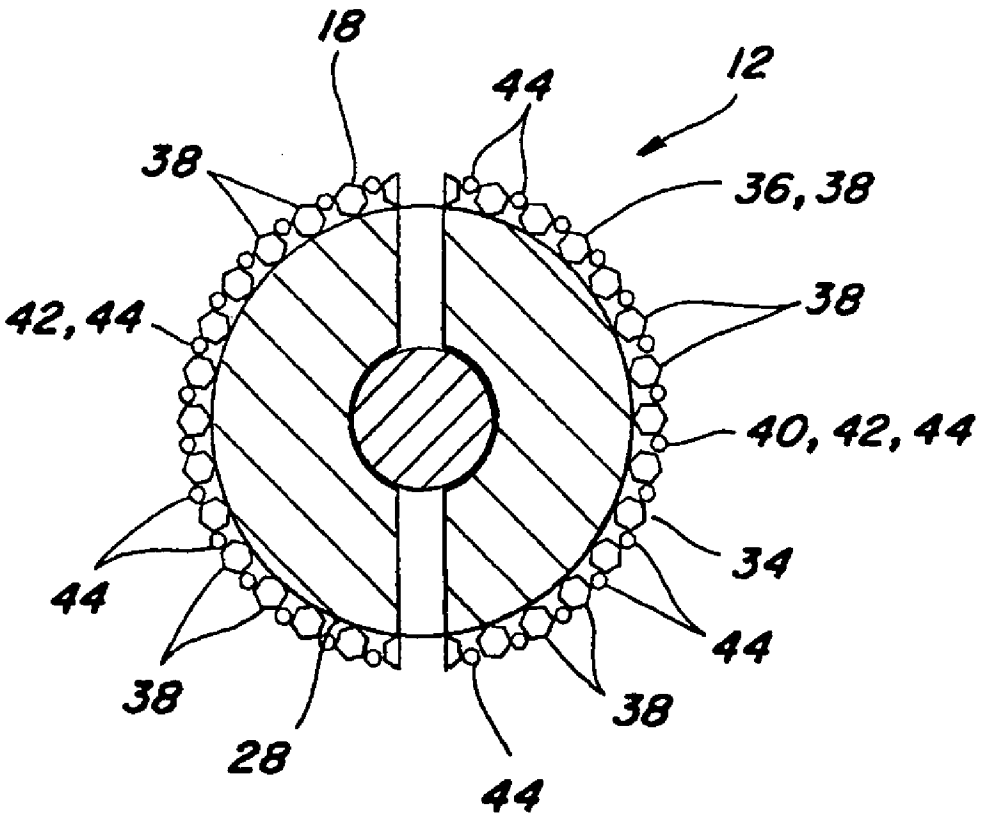
FIG. 4 is a cross-sectional view taken along line 4-4 of FIG. 2.
Figure 5:
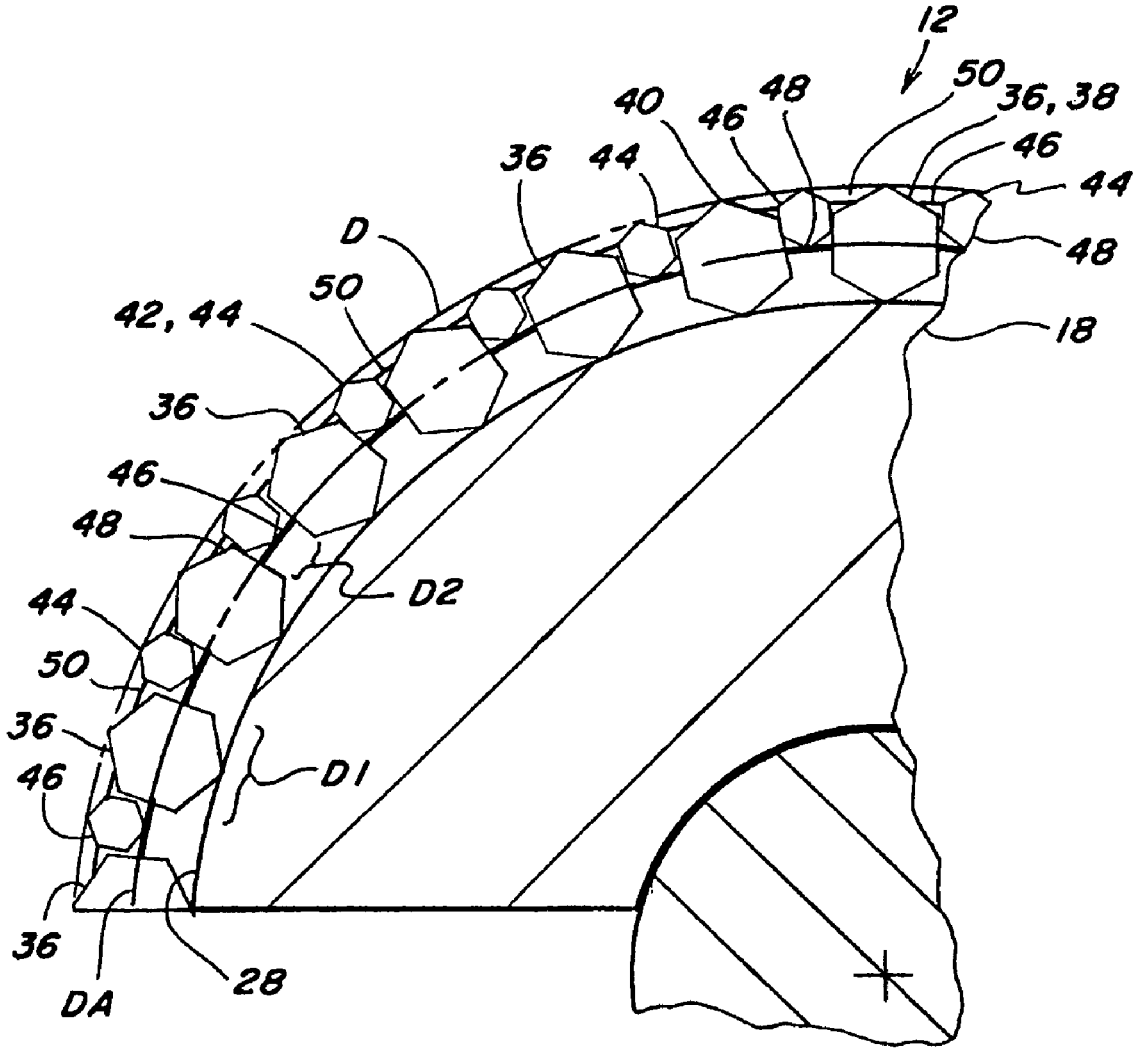
FIG. 5 is an enlarged fragmentary cross-sectional view of the honing tool of FIG. 1.

Referring also to FIGS. 4 and 5, surface 28 has a longitudinally extending region 34 thereabout and extending to free end 30, including a first layer 36 of abrasive particles 38 of a first size bonded thereto. Preferably, only a longitudinal endmost portion 40 of first layer 36 adjacent to free end 30 has a second layer 42 of abrasive particles 44 bonded thereto. Substantially all of abrasive particles 44 of second layer 42 have a second size which is equal to about one-half the first size of particles 38 or smaller, and particles 44 of second layer 42 are located at least substantially within voids or interstices 46 between adjacent ones of particles 38, such that entire region 34 of outer cylindrical surface 28, including the portion thereof including just first layer 36 of abrasives 38, and endmost portion 40 including both layers 36 and 42, has a substantially uniform outer diameter D, as denoted in FIG. 5.

First layer 36 of particles 38 is preferably bonded in place on surface 28 by bonding comprising a first plating layer 48, in the well-known conventional manner, using a metal plating material. Similarly, second layer 42 of particles 44 is preferably bonded onto first plating layer 48 by a second plating layer 50 of a metal plating material. Layer 36 preferably contains a maximum concentration of abrasive particles 38, such that the sizes of interstices 46 between adjacent ones of particles 38 are minimized. As noted above, this provides that layer with maximum wear characteristics, which are increased in the endmost portion 40 by the presence of second abrasive layer 42, while the overall cylindrical diameter D of the tool remains uniform under longitudinally asymmetrical honing stroke patterns wherein the endmost portion of the tool is in contact with the workpiece surface more of the time compared to the other portions of the abrasive region of the tool. Various representative plating methods and materials that can be used with the present invention are disclosed in Schimweg, U.S. Pat. No. 5,178,643, entitled Process for Plating Superabrasive Materials Onto a Honing Tool, issued Jan. 12, 1993, the disclosure of which is hereby incorporated by reference herein in its entirety.

Here, it can be observed that according to the invention, substantially all of the interstices 46 in which particles 44 of second layer 42 are located, are at least substantially radially outwardly of radial centers of particles 38 of first layer 36, respectively, which radial centers are denoted by a diametrical line DA in FIG. 5. As a result, although applied over first abrasive layer 36, particles 44 of second layer 42 effectively and substantially uniformly nest and are securely held within the matrix structure of particles 38 of first abrasive layer 36, and the cylindrical uniformity over the longitudinal extent of the abrasive portion of tool 12 is achieved, as evidenced by the uniformity of outer diameter D.

Here, it can also be observed that endmost portion 40 including both layers 36 and 42 of abrasives, comprises less than about one-third of an overall longitudinal extent of region 34, and is optimally about one-fifth of the overall extent of that region for a variety of applications, although this length can be increased or decreased as desired or required for a particular application.

As non-limiting examples of suitable abrasive sizes, for a tool having a diameter D of about 5 millimeters, a suitable first size D1 of respective abrasive particles 38 of first layer 36 is within a range of from about 0.10 millimeter to about 0.20 millimeter, and a second size D2 of particles 44 is within a range of from about 0.05 millimeter to about 0.10 millimeter, as measured diametrically through the respective particles, the smaller particles 44 being no more than about one-half the size of the larger particles 38, so as to fit in interstices 46 with a sufficient amount of plating material to be held in place. Other size ranges can be used. For example, for a larger tool, or if larger abrasives are otherwise desired or required, first size D1 can be within a range of from about 0.20 millimeter to about 0.30 millimeter, and second size D2 within a range of from about 0.10 millimeter to about 0.15 millimeter, again the smaller particles being on an order of one-half the size of the larger particles, or less. And, if smaller abrasives than those described above are desired, for example, for an even smaller tool, again, the smaller particles of the second layer will be no more than about one-half the size of the larger particles of the first layer.

First plating layer 48 can generally have a nominal thickness so as to extend from surface 28 to at least about a nominal center of particles 38, as generally denoted by diameter DA, or about one-half the size of particles 38, with plating layer 50 having a thickness extending from the first plating layer to marginally inwardly of overall diameter D. Alternatively, both particle layers can be bonded to surface 28 with a single plating layer, or other suitable binder, of a suitable thickness.

Figure 6:
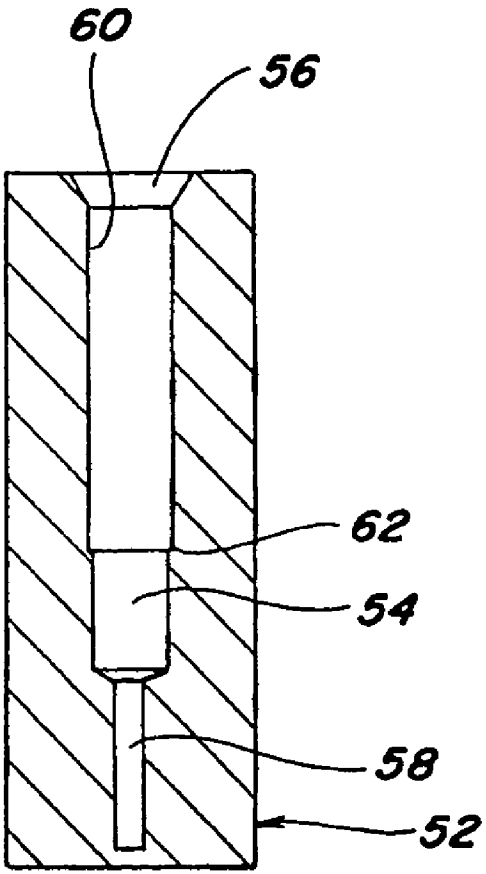
FIG. 6 is a cross-sectional view of a representative workpiece including a blind hole that can be honed using the honing machine and honing tool of FIG. 1.
Figure 7:
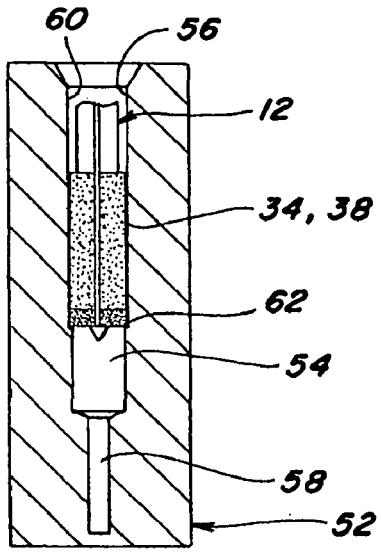
FIG. 7 is another cross-sectional view of the workpiece of FIG. 6, illustrating the honing tool disposed therein at the bottom extent of a honing stroke for honing a stepped portion of the hole.
Figure 8:
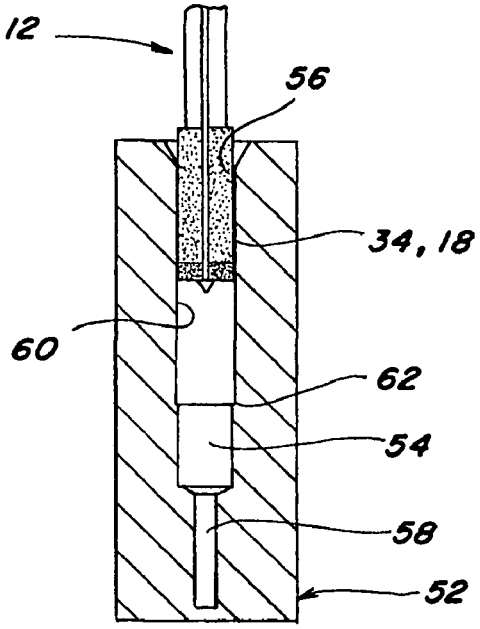
FIG. 8 is another cross-sectional view of the workpiece of FIG. 6, illustrating the honing tool at an intermediate position of the honing stroke for honing the stepped portion of the hole.

Referring also to FIGS. 6, 7 and 8, a representative workpiece 52 that can be honed using tool 12 is shown, including a blind hole 54, having an open end 56, an opposite closed end 58, and a surface region 60 of limited longitudinal extent from open end 56 to a shoulder 62, to be honed to a very precise diametrical size, roundness, and concentricity with a central axis of the hole. To accomplish this, in a representative honing process, workpiece 52 will be restrained in a fixture on machine 10 below honing tool 12, and tool 12 will be lowered in a retracted state into hole 54. Tool 12 will then be appropriately radially expanded such that longitudinally extending region 34 including the abrasive particles will be brought into abrading contact with surface region 60, as tool 12 is upwardly and downwardly stroked and rotated. Because of the presence of shoulder 62, region 34 of tool 12 generally cannot be stroked below that point, but can be stroked upwardly to a desired extent including wherein an upper portion of region 34 will extend upwardly beyond open end 56 so as to be out of contact with the workpiece surface and thus not subject to wear through that portion of the honing stroke. As result, endmost portion 40 and adjacent portions of region 34 will be in abrading contact with surface region 60 for a greater portion of the honing stroke compared to other portions of region 34 opposite endmost portion 40, so as to be subject to greater wear producing conditions. Advantageously, it has been found that the presence of additional second abrasive layer 42 significantly increases the wear resistance of endmost portion 40, such that region 34 of tool 12 will wear at a substantially uniform overall rate, and, of great significance, while being capable of longitudinally asymmetrically honing surface region 60 of a large number of workpieces to a precise, substantially uniform cylindrical dimension, roundness and concentricity. As a result, quality improved compared to more irregularly wearing honing tools, and a greater number of workpieces can be honed with each tool.

Here, it should be understood that it is contemplated according to the invention, that a wide variety of well-known, conventional abrasive materials can be used with the present tool, as appropriate for honing a variety of materials. Representative abrasives can include, but are not limited to, natural and synthetic diamonds, cubic boron nitrides, and superabrasives, of appropriate hardness, friability, compatibility and other characteristics for particular applications.

It should also be understood that it is contemplated that the teachings of the present invention can be applied to other, non-cylindrical shape tools, such as, but not limited to, tools having a single taper or multiple tapers at one or both ends, and a tool using multiple abrasive sticks or the like extending radially about a mandrel.

Thus, there has been shown and described a novel honing tool construction, particularly adapted for honing blind bores or holes and the like and a novel method of using such tool which fulfill all of the objects and advantages sought therefor. It will be apparent to those skilled in the art, however, that many changes, variations, modifications, and other uses and applications of the subject tool and method are possible, and all such changes, variations, modifications, and other uses and applications which do not depart from the spirit and scope of the invention are deemed to be covered by the invention which is limited only by the claims which follow.

What is claimed is:

1. A honing tool for honing a substantially cylindrical surface extending around and defining a hole in a workpiece, the tool comprising:

an elongate radially expandable tubular member having a mounting end configured for attaching to a honing machine, and an opposite free end portion configured to be insertable into the hole in the workpiece, the tubular member including a radially outwardly facing outer cylindrical surface;

at least one expander member located within the tubular member and movable relative thereto for radially expanding the tubular member in the hole of the workpiece; and wherein the outer cylindrical surface of the tubular member includes a longitudinally extending region thereabout including a first layer of abrasive particles of a first size bonded thereto, and wherein only a longitudinally limited portion of the first layer of the abrasive particles of the first size has a second layer of abrasive particles bonded thereto, substantially all of the abrasive particles of the second layer having a second size which is equal to about one-half the first size, and being located at least substantially within interstices between the particles of the first layer, such that the region of the outer cylindrical surface has a substantially uniform outer diameter.

2. The honing tool of claim 1, wherein substantially all of the interstices between the particles of the first layer in which the particles of the second layer are located, are located at least substantially radially outwardly of radial centers of the particles of the first layer, respectively.

3. The honing tool of claim 1, wherein the limited portion of the first layer comprises an end portion of the first layer.

4. The honing tool of claim 1, wherein the limited portion of the first layer comprises an end portion of less than about one-fourth of an overall longitudinal extent of the first layer.

5. The honing tool of claim 1, wherein the first size is within a range of from about 0.10 millimeter to about 0.20 millimeter, and the second size is within a range of from about 0.05 millimeter to about 0.10 millimeter.

6. The honing tool of claim 1, wherein the first size is within a range of from about 0.20 millimeter to about 0.30 millimeter, and the second size is within a range of from about 0.10 millimeter to about 0.15 millimeter.

7. The honing tool of claim 1, wherein the particles of the first size are bonded to the tubular member by a first layer of a binder, and wherein the particles of the second layer are bonded to the first layer of the binder by a second layer of a binder.

8. The honing tool of claim 7, wherein the binders comprise plating.

9. The honing tool of claim 1, wherein the free end portion of the tubular member is split to facilitate expansion thereof.

10. The honing tool of claim 1, wherein the particles of the first size of the first layer are distributed in a maximum particle concentration over the region of the outer cylindrical surface of the tubular member.

11. A honing tool for honing a cylindrical surface extending around and defining a hole in a workpiece, the tool comprising:

an elongate radially expandable tubular member having a mounting end configured for attaching to a honing machine, and an opposite free end portion sized in a retracted state to be insertable into the hole in the workpiece and radially expanded therein, the tubular member including a radially outwardly facing outer cylindrical surface, and a radially inwardly facing inner tapered surface defining a passage extending axially within the tubular member;

an elongate expander member having a mounting end configured for attaching to the honing machine, and an opposite free end portion located in the passage of the tubular member and having an outwardly facing outer tapered surface engaged with the inner tapered surface of the tubular member and movable longitudinally relative thereto for radially expanding the tubular member; and wherein a predetermined longitudinal extent of the outer cylindrical surface of the tubular member adjacent to the free end portion includes a first layer of abrasives of a first size bonded thereto, and wherein only an endmost portion of the first layer of the abrasives adjacent to the free end portion and comprising less than one-half of the longitudinal extent includes a second layer of abrasive particles bonded thereto, substantially all of the abrasive particles of the second layer having a second size sufficiently smaller than the first size such that substantially all of the particles of the second size are located only within interstices between the particles of the first size, such that the layers of the abrasives have a substantially uniform outer diameter along substantially the entire longitudinal extent.

12. The honing tool of claim 11, wherein the second size is less than or equal to about one-half of the first size.

13. The honing tool of claim 12, wherein the first size is within a range of from about 0.10 millimeter and about 0.30 millimeter, and the second size is within a range of from about 0.05 millimeter and about 0.15 millimeter.

14. The honing tool of claim 11, wherein the endmost portion comprises less than about one-fourth of an overall longitudinal extent of the first layer.

15. The honing tool of claim 11, wherein the abrasive particles of the first layer are bonded to the tubular member by a first layer of a binder, and wherein the particles of the second layer are bonded to the first layer of the binder by a second layer of a binder.

16. The honing tool of claim 15, wherein the binders comprise plating.

17. The honing tool of claim 11, wherein the abrasives are selected from a group consisting of natural diamonds, synthetic diamonds, cubic boron nitrides, and superabrasives.

18. A honing tool for honing a cylindrical surface extending around and defining a hole in a workpiece, the tool comprising:

an elongate radially expandable tubular member having a mounting end configured for attaching to a honing machine, and an opposite free end portion sized in a retracted state to be insertable into the hole in the workpiece and radially expanded therein, the tubular member including a radially outwardly facing outer cylindrical surface, and a radially inwardly facing inner tapered surface defining a passage extending axially within the tubular member;

an elongate expander member having a mounting end configured for attaching to the honing machine, and an opposite free end portion located in the passage of the tubular member and having an outwardly facing outer tapered surface engaged with the inner tapered surface of the tubular member and movable longitudinally relative thereto for radially expanding the tubular member; and wherein at least a portion of the outer cylindrical surface of the tubular member adjacent to the free end portion includes a first layer of abrasives of a first size bonded thereto, and a second layer of abrasive particles bonded onto at least a portion of the first layer, substantially all of the abrasive particles of the second layer having a second size sufficiently smaller than the first size such that substantially all of the particles of the second size are located only within radially outwardly facing interstices between the particles of the first size.

19. The honing tool of claim 18, wherein the second size is less than or equal to about one-half of the first size.

20. The honing tool of claim 19, wherein the first size is within a range of from about 0.10 millimeter and about 0.30 millimeter, and the second size is within a range of from about 0.05 millimeter and about 0.15 millimeter.

21. The honing tool of claim 18, wherein the portion of the first layer comprises less than about one-fourth of an overall longitudinal extent of the first layer.

22. The honing tool of claim 18, wherein the abrasive particles of the first layer are bonded to the tubular member by a first layer of a binder, and wherein the particles of the second layer are bonded to the first layer of the binder by a second layer of a binder.

23. The honing tool of claim 22, wherein the binders comprise plating.

24. The honing tool of claim 18, wherein the abrasives are selected from a group consisting of natural diamonds, synthetic diamonds, cubic boron nitrides, and superabrasives.

* * * * *